US005305875A

United States Patent [19]

Meyer

[11] Patent Number: 5,305,875

[45] Date of Patent: Apr. 26, 1994

[54] FOLD-UP DISPLAY CONTAINER

[75] Inventor: Stephen T. Meyer, Indianapolis, Ind.

[73] Assignee: Deflecto Corp., Indianapolis, Ind.

[21] Appl. No.: 61,417

[22] Filed: May 13, 1993

Related U.S. Application Data

[63] Continuation of Ser. No. 834,000, Feb. 11, 1992, abandoned.

[51] Int. Cl.[5] ..... B65D 5/52; B65D 6/26

[52] U.S. Cl. ..... 206/45.25; 220/7; 220/4.28; 220/62

[58] Field of Search ..... 206/45.24, 45.25, 45.26, 206/45.27, 45.28, 1.5, 425; 220/6, 7, 4.28, 62, 665, 339

[56] References Cited

U.S. PATENT DOCUMENTS

| | | | |
|---|---|---|---|
| 71,511 | 11/1867 | Mershon . | |
| 2,393,103 | 1/1946 | Groedel | 206/45.27 |
| 3,185,294 | 5/1965 | Lustman . | |
| 3,446,415 | 5/1969 | Bromley | 220/62 |
| 3,497,127 | 2/1970 | Box | 220/7 |
| 3,744,623 | 7/1973 | Woofter . | |
| 3,900,157 | 8/1975 | Roth . | |
| 3,924,798 | 12/1975 | Saveth | 220/62 X |
| 4,202,457 | 5/1980 | Tansi | 220/62 X |
| 4,331,231 | 5/1982 | Boyle | 206/45.25 |
| 4,433,778 | 2/1984 | Maio et al. | 206/45.25 |
| 4,579,232 | 4/1986 | Fedak | 206/45.25 X |
| 4,819,792 | 4/1989 | Christian . | |
| 4,943,024 | 7/1990 | Meyer . | |
| 5,083,663 | 1/1992 | Conway et al. | 206/45.26 |
| 5,114,034 | 5/1992 | Miller et al. | 220/62 X |
| 5,150,813 | 9/1992 | Harris et al. | 206/45.26 X |

OTHER PUBLICATIONS

*Creative Magazine*, Jan. 1991 issue, p. 273, published by Magazines/Creative, Inc. of New York City.

*1992 Buyers Guide and Price List*, of Fasteners for Retail Co (FFR), p. 32 depicting "Shipflat" Info Holders.

*Primary Examiner*—Paul T. Sewell

*Assistant Examiner*—Jacob K. Ackun, Jr.

*Attorney, Agent, or Firm*—Woodard, Emhardt, Naughton, Moriarty & McNett

[57] ABSTRACT

A fold-up display container for printed material, discrete articles and the like includes a single, integrally molded plastic unit including a base panel, a front panel, a rear panel, left and right side panels and support panels. Each of the panels are interconnected by means of molded, flexible and integrally connected hinge portions whereby the front panel is hinged to the base panel, the side panels are each hinged to the base panel and the rear panel is hinged to the base panel. The support panels are hinged on opposite sides of the rear panel and in the folded-up orientation a box-like structure is created including the base and four sides and the four sides are interconnected and locked into each other by means of a locking tab and slot arrangement. Front elevator feet are used to orient the container in an inclined and rearwardly tilted position when used for horizontal countertop display.

5 Claims, 4 Drawing Sheets

FOLD-UP DISPLAY CONTAINER

This application is a continuation of application Ser. No. 07/834,000, filed Feb. 11, 1992, now abandoned.

BACKGROUND OF THE INVENTION

The present invention relates generally to free-standing, self-supporting containers which may be used to store and display various articles, particularly printed material. More specifically the present invention relates to a plastic fold-up display container which incorporates living hinges and a locked, snap-fit assembly of folded panels.

In the design of plastic containers that store, hold and/or display articles, such as printed material, there are several construction options which may be employed. One option is for the container to be molded, normally by an injection molding process, as a one-piece integral unit. One example of an injection molded structure is found in U.S. Pat. No. 4,943,024, issued Jul. 24, 1990 to Meyer, referring to chart and file holder 20. Another option is to create the container by the assembly of individually molded pieces. The assembly technique may be by means of a snap-fit as disclosed in U.S. Pat. No. 4,943,024, referring to legs 66 and 67 which snap onto holder 60. Separate pieces may also be attached by fasteners or adhesive. A third option is to create the container from a one-piece form including hinged panels which are then folded up and snapped together in order to create a free-standing, self-supporting display container. The present invention is structural along the lines of this third construction option.

The advantages of the present invention include the molded efficiency of the flat form, unitary construction and the absence of several different, individualized component parts which would have to be separately fabricated and then assembled. The molded flat form of the present invention, prior to folding it up into the display container form, provides packaging, shipping and storage efficiencies over the corresponding inefficiencies of containers which may be initially molded or assembled in three-dimensional form. With the present invention, the end user performs the assembly steps and thus is able to both fold up the display container as well as unfold or knock it down for ease of storage at any time in the life cycle of the display container when it is not in use. The particular snap fit approach followed in the present invention, although intended to be permanent once it is folded up, is still reversible such that the folded-up form can be disassembled back to the flat form.

While other flat-form, fold-up plastic containers are known to exist, the present invention has certain advantages over these earlier designs. One such earlier design is found in U.S. Pat. No. 4,819,792 issued Apr. 11, 1989 to Christian. This patent discloses a folding display for use as either a countertop or wall display. The structure begins as a single stamping and is then folded and the side edges of the various panels are interlocked in order to hold the folded form. Score lines are disposed between adjacent panels so that the bend between panels is clean and neat.

In Christian, the side panels are formed with rigid, planar extensions (i.e., feet) which are required to help support the display on a flat surface. When the option of wall mounting is desired, a different styled support is required as the feet cannot be hinged flat against the sides or back for any optional wall mounting using the same design. When wall mounting is desired, the pair of support feet must be replaced with a single, central foot which is described as being of the type common in desk calendars which can be made to bend out of the way for the desired wall mounting. This desk calendar type of foot is not believed to be as sturdy as the dual feet arrangement, but in Christian the dual feet cannot be interchangeably converted between a wall mounting configuration and a countertop support configuration.

In the present invention, feet are hinged to the rear panel and can be folded out for a countertop display or left in their originally molded orientation flush with the rear panel to enable a flush wall mounting configuration. In the present invention, the plastic material which is used has a short memory and thus when the support feet are hinged in a rearward direction, they will stay in that orientation without any need for further interlocking or holding structures. In Christian, the tilted orientation as illustrated for the countertop display is achieved by means of two cooperating design features. The first feature involves hinging the side panels to the front panel and the second feature involves angling the lower edge of the side panel and feet. This angled lower edge is such that in its flat form the included angle between the angled lower edge and the side edge of the base is greater than 90 degrees. In the present invention, the side panels are hinged to the base panel rather than to the front panel and thus cannot be used to create any tilt in the display container. As a consequence, the present invention uses two front feet which are cut in an offset fashion relative to the integral connecting hinge (i.e.. the fold line) between the front panel and base panel so as to extend below the base panel at the front edge.

In U.S. Pat. No. 3,744,623 issued Jul. 10, 1973 to Woofter, a plastic self-locking caddy is disclosed. The caddy includes a base panel, a front panel, a pair of side Panels and a rear panel. The free edges of the side panels fit into channels in the rear panel and base panel and locking tabs fit into rear panel slots in order to hold the caddy in the closed and erected position. This design is not intended to be free-standing as there are no legs and the base is smaller than the top suggesting that any attempt to make the caddy free-standing would result in it tipping over or at least having an unacceptable level of stability.

In U.S. Pat. No. 3,185,294 issued May 25, 1965 to Lustman an easel is disclosed which begins as a flat sheet of material and is folded closed much like a box is folded into a closed condition with the various flaps tucked into position between adjacent panels of material. In Lustman there are in fact flaps very similar to a box and these are folded and tucked into seams in order to create a display package which includes a pair of tabs 3 and 4 hinged to back portion 6 and which serve to maintain the easel in an upright position. In this design there are no snap-fit or interlocking features used to hold the form of the easel. This lack of interlocking features is made possible by the folded box-like configuration. What is sacrificed is the ability to provide an open-top container for the display of printed material or for holding discrete articles. Also lost by the specific structure of Lustman is any recognition of design changes to enable the easel to be wall mounted. The angled cut of side panels permits the easel to be positioned with a slight rearward incline. While this configuration may appear subtly minor, it is subtly important.

In the present invention there are front feet which provide for a slight elevation and thus a rearward incline for the present invention when it is mounted on a countertop or other horizontal support surface. In Lustman as in Christian the base panel is horizontal when the device is in the folded and erected position and thus if Lustman was configured to hold printed material by opening the top panel, the top edges of the printed material would be horizontal as is the case with Christian. In order to grasp one copy or one thickness of the printed material one would have to find a top edge and be able to pull that one copy forward in order to grasp the copy with the fingers. Single sheet printed material which is stacked together does not always present a free edge of the first copy apart from the remaining copies and thus use of the fingernail or a fanning motion of the multiple copies is needed in order to separate the first copy from the remainder. When all the top edges are horizontally flush, care must be taken to separate and select a single copy.

In contrast, in the present invention the base panel is inclined upwardly along its front edge and thus the top edges of the printed material are likewise inclined with the foremost or front copy slightly elevated from the second and third copies, and so forth. Consequently, the top edge of the forward most copy is slightly higher, relative to horizontal, and is more easily separated from the remaining copies. By means of a drawing motion of the fingers in a horizontal direction across the top, protruding edge of the printed material the first copy will more easily be selected by the customer or user. The present invention allows the printed material to have a forward protruding, slightly elevated front edge which makes selection of the material easier and reduces the risk that waste will result. Typically when a customer or user cannot select one copy from the remainder they will take two or three copies and those extra copies are simply thrown away resulting in waste and inefficiency. In the present invention the first copy is able to pivot forward slightly separating itself from the remainder without any bending or creasing and without having to fan the multiple copies in order to separate one from the remainder.

Another advantage of the angled or inclined floor of the base panel in the present invention is that the printed material will naturally lay back against the rear panel. Consequently, as the quantity of copies decreases the remaining stack of copies will lay neatly against the back panel due to this incline rather than possibly leaning forward and with time sagging or drooping over the front edge of the display. In displays of this type, it is important that the printed material be visible so that the person selecting a copy will be able to choose from different offerings. If the material is supported on a horizontal base surface, the front copies could easily lean forward as the quantity is reduced. If the copies droop or sag forward so that their content cannot be visually reviewed, the printed material which one wishes to distribute may simply not be as readily selected. This problem is eliminated by the specific design of the present invention.

SUMMARY OF THE INVENTION

A fold-up display container for printed material, discrete articles and the like according to one embodiment of the present invention comprises an integrally molded sheet of plastic initially in flat form and including a plurality of panels which are integrally hinged to one another and designed to be folded into a receiving configuration. The fold-up display container includes a base panel, a front panel, a rear panel and two side panels. The front panel, rear panel and the two side panels are each hinged to the base panel. Locking tabs and slots are provided so as to secure the front panel to the side panels and to secure the side panels to the rear panel. Hinged to the rear panel are support legs which may be bent backwards in order to steady and support the container when it is to be placed on a horizontal surface. Additionally the front panel includes two support feet which extend below the lower edge of the base panel thereby creating a slight rearward incline to the container.

One object of the present invention is to provide an improved fold-up display container.

Related and advantages of the present invention will be apparent from the following description.

DESCRIPTION OF THE PREFERRED EMBODIMENT

Figure 1:
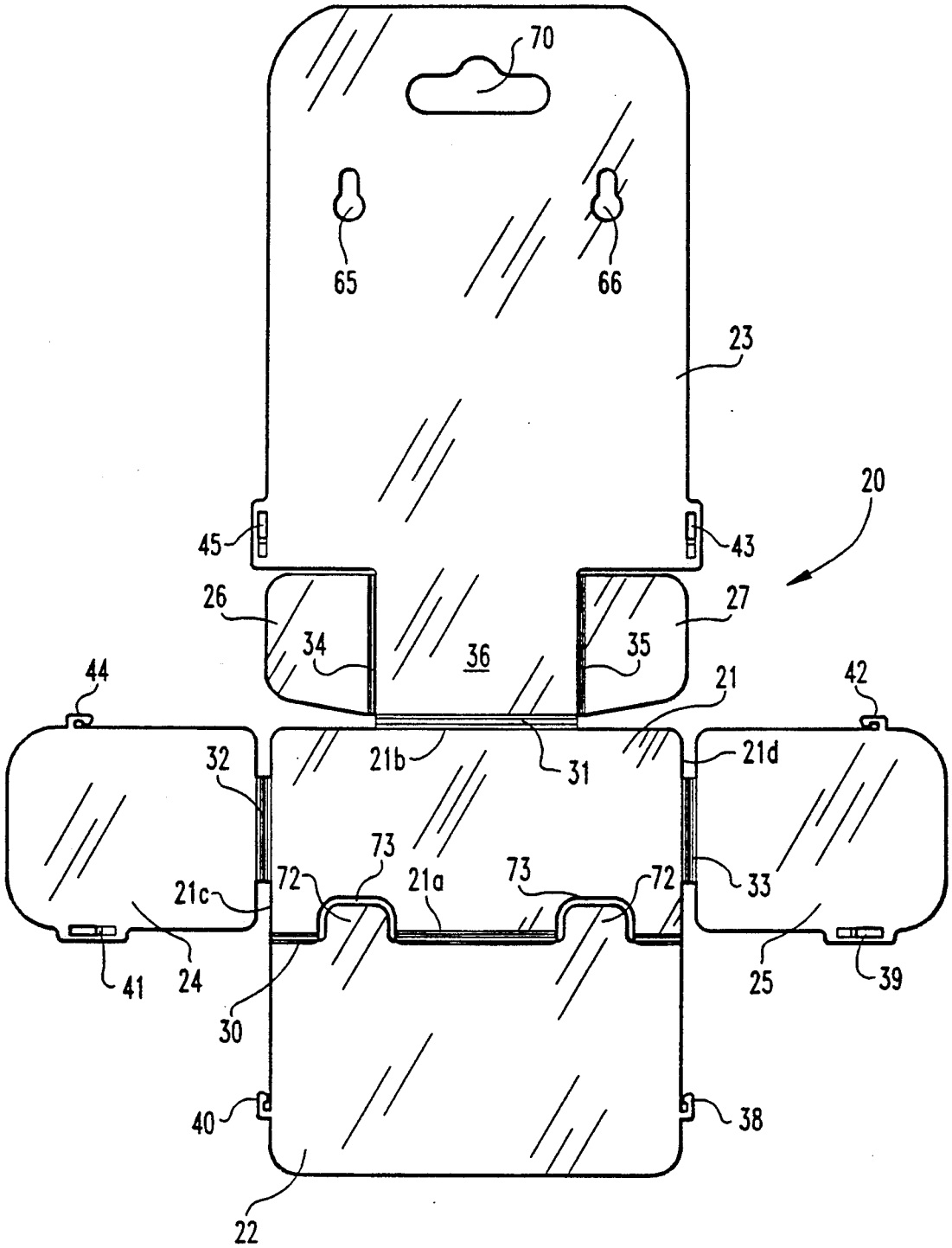
FIG. 1 is a top plan view of a fold-up display container as initially molded in flat form according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a fold-up display container 20 as initially injection molded out of plastic in flat form including a plurality of panels and living hinges all of which are integrally joined as a single, one-piece unit. The surfaces are shaded or lined to represent a transparent, slightly reflective surface as would be the case when the container 20 is molded from clear plastic.

Figure 6:
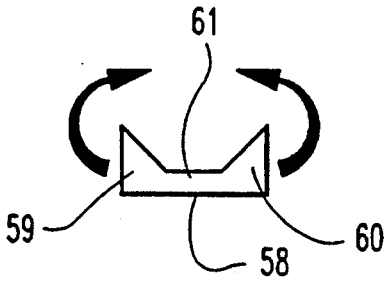
FIG. 6 is an end elevational view in full section showing the shape of the living hinges which are used in the FIG. 1 display container according to the present invention.

Specifically, display container 20 includes base panel 21, front panel 22, rear panel 23, left side panel 24, right side panel 25, left side support 26 and right side support 27. The base panel includes a front edge 21*a*, rear edge 21*b* and opposite side edges 21*c* and 21*d*. The other four panels have lower edges which connect to the base panel and opposite side edges. The front panel 22 is integrally connected with the base panel 21 by means of a flexible living hinge 30 which comprises a portion of the overall display container. The hinge design throughout display container 20 is of the same cross-sectional configuration as is illustrated in FIG. 6. The manner in which this hinge is molded and its various contours and lateral cross-sectional thicknesses result in a tendency to be freely bent in one direction. While the hinge could be bent in a reverse direction, there is greater resistance due to its cross-sectional configuration.

Additional integral flexible hinges are disposed between the base panel and the two side panels, between the base panel and the rear panel and between the rear panel and the side supports. Specifically, flexible hinge 31 is disposed between the base panel 21 and the rear panel 23. Flexible hinge 32 is disposed between base panel 21 and left side panel 24. Flexible hinge 33 is disposed between base panel 21 and right side panel 25. Flexible hinge 34 is disposed between left side support 26 and rear panel 23. Flexible hinge 35 is disposed between right side support 27 and rear panel 23.

As is illustrated in FIG. 1, rear panel 23 is offset in such a fashion that portion 36 of the rear panel 23 is of a reduced width allowing for the positioning of the left and right side supports 26 and 27, respectively. This allows the side supports to effectively fill in the open area which is left by the reduced width of portion 36 such that when the left and right side supports are not used to support and stabilize the display container 20 on a countertop or other horizontal surface, these side supports will remain flush with the rear panel and enable the entire display container to be mounted flush against a wall or other vertical surface.

As previously mentioned, display container 20 is a one-piece, integral unit which is injection molded. The material which is used is polyethylene terephthalate which is a versatile thermosetting/thermoforming polyester with a short memory and having warpage resistance. The concept of a "short memory" in the sense of plastic materials simply means that the position which the plastic may be in at one point in time can be altered and it will not remember or retain its former position. As a consequence of the short memory the material will not tend to flex or creep back to its former position. The effect of this particular material selection allows the left and right side supports 26 and 27 to be bent in a rearward direction so that they are roughly at a 90 degree angle relative to the plane of the rear panel 23 and for these side supports to remain in that position. Although these side supports by means of the intergally connecting hinges 34 and 35 are initially flush with the rear panel, they can be easily bent, noting the specific hinge configuration, in a rearward direction and once positioned, they will tend to stay in that position. However, these side supports can also be returned to the orientation where they are flush with the rear panel if at some point they user of this display container would like to change it from a horizontal countertop mounting to a vertical wall mounting.

Figure 3:
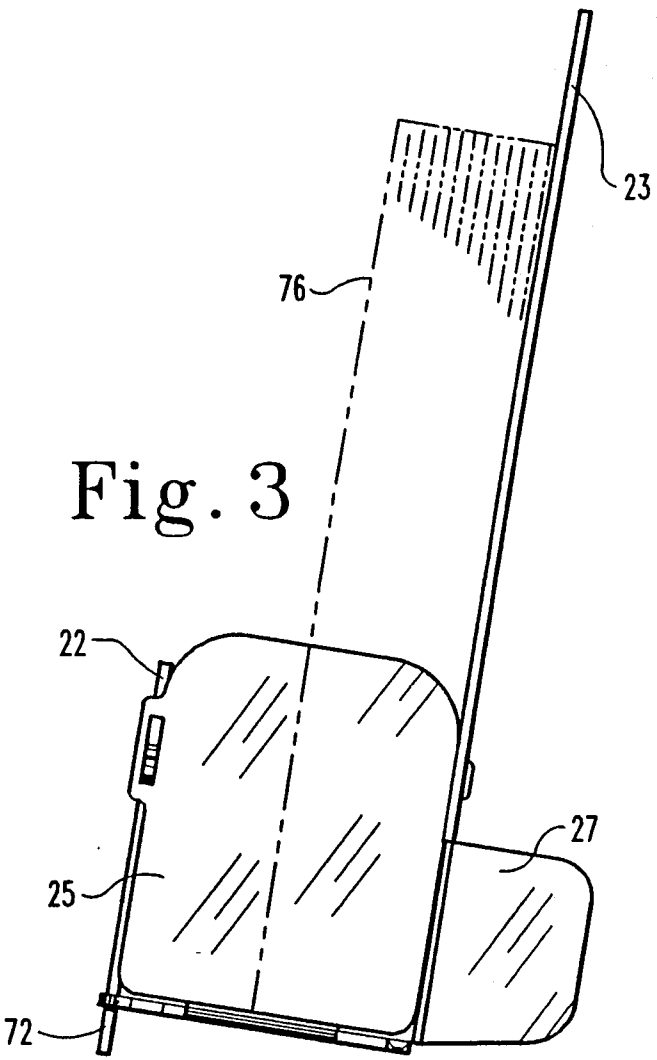
FIG. 3 is a side elevational view of the FIG. 1 display container as folded into a receiving configuration.
Figure 2:
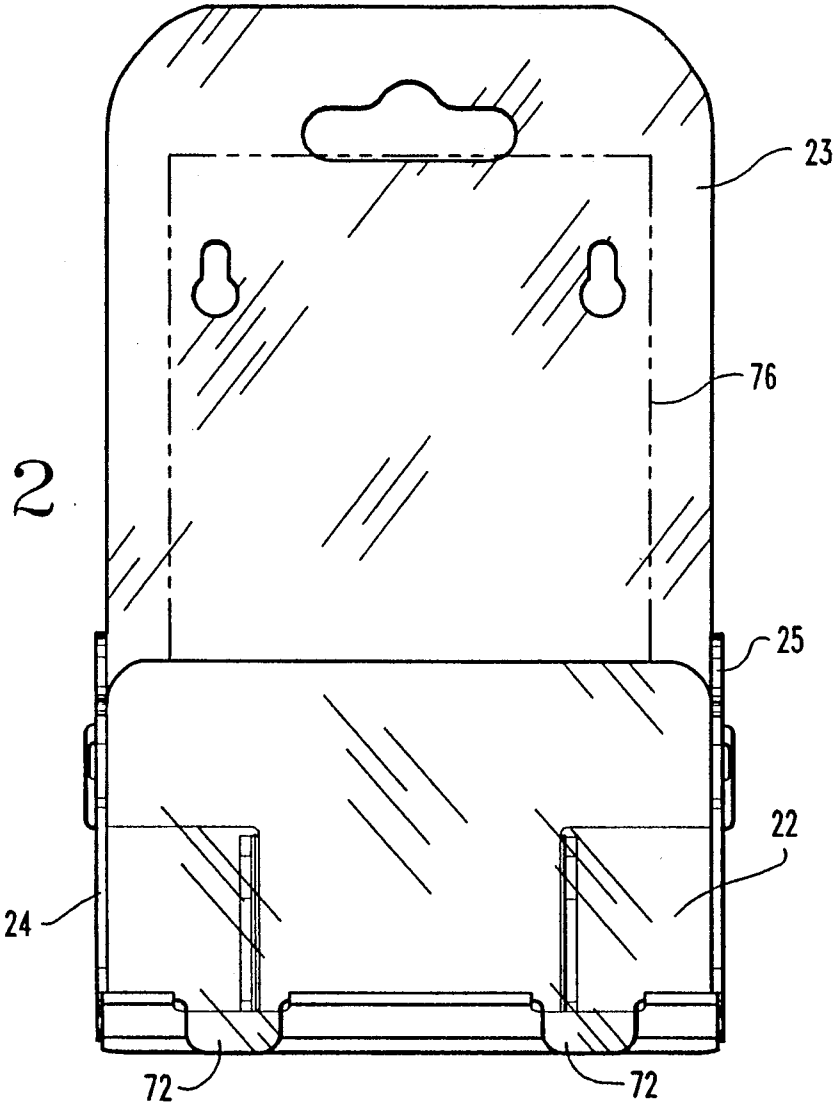
FIG. 2 is a front elevational view of the FIG. 1 display container as folded into a receiving configuration.
Figure 4:
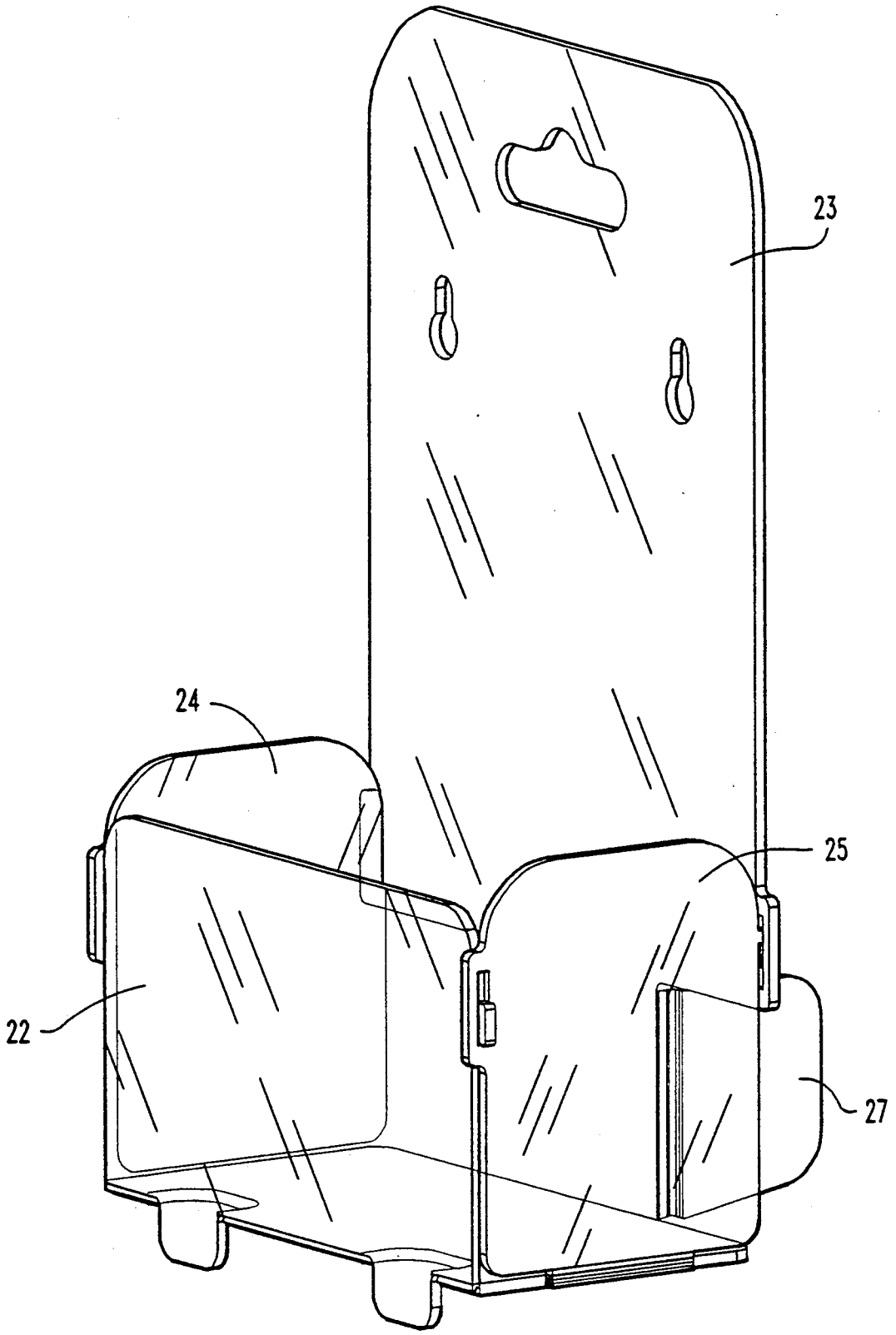
FIG. 4 is a perspective view of the FIG. 1 display container as folded into a receiving configuration.

Inasmuch as each of the integral connecting flexible hinges are of the same cross-sectional configuration as illustrated in FIG. 6, it should be understood that they are each oriented such that the intended or anticipated direction of fold of the various panels into the folded and erected configuration of FIGS. 2 through 4 is facilitated. For this reason the FIG. 1 illustration shows each of the hinges as a series of closely spaced lines denoting the various contour edges as revealed in FIG. 6. The back side or under side of each hinge is a substantially flat and smooth edge and that is the edge which is bent into a convex form and which comprises part of the outer surface of the folded up display container.

Although the flexible hinges will tend to stay in their folded up orientation, due to the particular material selection, in order for the display container to be suitable to hold printed material, discrete articles or similar items, some type of securing or interlocking means is needed between the four panels which comprise the four sides of the folded up display container. The present invention thus incorporates snap-fit locking members of a tab and slot style as is illustrated in FIGS. 1 through 4 and which is illustrated in an enlarged detail in FIG. 5. The front panel, rear panel, left side panel and right side panel are each substantially flat and each includes either a coplanar interlocking tab of a coplanar interlocking slot outwardly extending from each side edge of its integral and corresponding panel. These interlocking tabs and slots are arranged in cooperating pairs (i.e. one tab fitting into one slot) in order to secure adjacent panels together. As will be seen, one side edge of front panel 22 includes a snap-fit locking tab 38 which corresponds with snap-fit locking slot 39 positioned in the adjacent edge of right side panel 25. The opposite side of the front panel is provided with another snap-fit locking tab 40 which cooperates with locking slot 41 which is disposed in one side of left side panel 24. The opposite side of right side panel 25 includes a snap-fit locking tab 42 which cooperates with locking slot 43 disposed in one edge of rear panel 23. In a similar fashion, snap-fit locking tab 44 which is disposed in the opposite edge of left side panel 24 cooperates with locking slot 45 disposed in the opposite side edge of rear panel 23. As the various panels are flexed into an upright folded orientation, the various tabs and slots interlock with one another to hold the folded form of display container 20.

Figure 5:
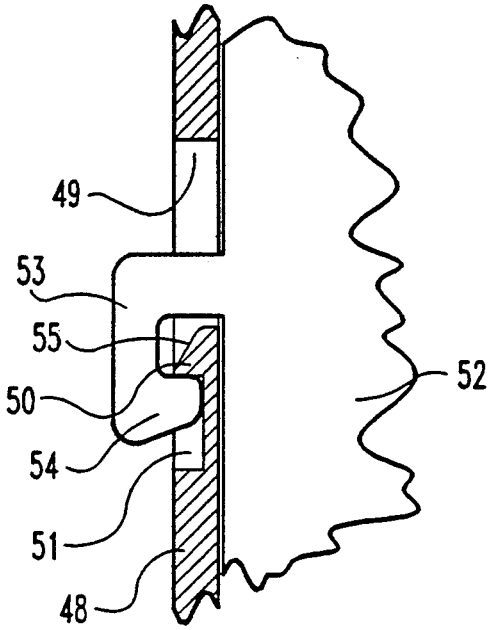
FIG. 5 is a side elevational view of an enlarged detail of the snap-fit, interlocking structure used to hold adjacent panels of the FIG. 1 display container together according to the present invention.

Due to some flexibility and movement afforded by each of the integrally connecting hinges, it is possible to insert each tab directly into the upper open clearance space of the corresponding slot and thereafter lower the tab such that it rides over a protruding lip of the slot until it snaps into an interlocked position. As illustrated in FIG. 5 which is an enlarged detail, panel 48 which is intended to be representive of those panels or portions of panels which include a slot includes basically three important structural features with regard to the interlocking assembly. First there is an open clearance space 49 into which the tab may be directly inserted. Secondly, there is an interlocking lip or step 50 positioned directly below the opening. And finally there is an undercut or recess opening 51 positioned directly beneath step 50.

With regard to panel 52, this is intended to be representive of those panels or panel portions which include one of the snap-fit locking tabs. As can be seen, the vertical height of tab 53 is slightly less than the vertical height of clearance opening 49 thereby allowing the entirety of generally U-shaped tab 53 to be inserted directly into opening 49. Once the two panels 48 and 52, are flush with each other, panel 52, by means of the flexible hinge which connects the panel to the base panel, is lowered so that the leading head 54 rides up over and outwardly from ramp surface 55. As the tab is lowered it will flex slightly in an outward direction until head 54 gets beyond the under edge of step 50 at which point head 54 will snap back into recess 51. The result is a secure locking arrangement which easily holds each of the adjacent panels to one another as part of the folded configuration.

Although it is intended that a user of this product will initially decide whether or not to use the device as a horizontal countertop display or as a vertical wall mounted display, it is conceivable that one could convert from one configuration to the other. All that needs to be done is simply return the side supports 26 and 27 to a flush position when converting to a wall mounted orientation or bend them from a flush orientation to a 90 degree orientation relative to the rear panel when it is desired to mount the display container on a horizontal surface. Under either arrangement the front panel, rear panel and side panels remain interlocked. If there would ever come a time that one would want to return the display container from its folded and interlocked condition to a flat form, the locking tabs could be pried out of engagement with the various slot recesses 51 while raising the slot panel in an upward direction. Although it is not the intended purpose of the present invention that it will be frequently converted from a flat form to a folded form and then back to a flat form, it can be done.

Referring specifically to FIG. 6, the shape of each of the connecting living hinges is illustrated. As will be noted, each hinge has a underside flat surface 58 and two outwardly raised and tapered side portions 59 and 60. The middle section 61 is of a thinner material than either of the outer portions and thus this is the area which gives or yields most readily during the flexing action.

With regard to the provisions for wall mounting, it can be seen from the FIG. 1 illustration that the rear panel is provided with a pair of keyhole apertures 65 and 66 which would typically be used when mounting the display container over the heads of screws or similar threaded fasteners. Also included is a larger opening 70 which may be used for a hook or other protrusion.

Returning briefly to the FIG. 2, 3, and 4 illustrations, each of these pertain to a countertop or horizontal mounting and in this orientation it is desired to have some rearward tilt or incline. In order to provide this feature it will noted that the front panel 22 is provided with a pair of spaced feet 72 which extend beyond the edge of the front panel into recess openings 73 in the base panel. To the extent that feet 72 extend beyond the hinge line connecting the front panel to the base panel, it will be appreciated that these feet will thus extend down below the surface of the base panel along its front edge. This particular configuration is well illustrated in FIG. 3 which shows how feet 72 extend below the front edge of the base panel 21 and provide a rearward tilt and elevation. It is also important to note that the inside surface of the base panel, the surface which will in fact support printed material, is also inclined and is not horizontal. The result is that any printed material such as flyers, brochures, folders or pamphlets will be tilted back at a slight incline as is illustrated by the broken line outline in FIG. 3. This broken line outline 76 (see FIGS. 2 and 3) is intended to represent a stack of printed material which is disposed within the receiving compartment of the present invention which is defined by the base, the rear panel, the front panel and the two side panels. Due to this rear incline angle the printed material simply by its own weight and gravity will lay backwards against the rear panel. This is desireable so that as the quantity of printed material is reduced the remaining copies will stay neat and stacked and will lay back rather than tilting forward or drooping over which would prevent one from readily seeing the nature of the printed material and being able to decide whether or not a copy is desired. By the incline of the base panel and the tilting back of the printed material, it is always visible and if a copy is desired it can be easily selected.

It will also be noted that with this tilt back design, the top front edge of the first or forward most copy of the printed material is slightly elevated above the forward top edge of the next copy. Consequently when one wishes to select one copy of the offered printed material it is relatively easy to catch that top leading edge by the finger or fingernail and only remove one copy rather than two or three copies. As will be appreciated, when the printed material has a top horizontal surface rather than an incline surface, it is not as easy to select a single copy without fanning forward the multiple copies so as to get some separation between the front copy and the second copy. That fanning maneuver is not required with the present invention because only a single material edge is presented as the uppermost edge of the printed material.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fold-up display container for printed material and discrete articles which is initially in flat form and folded into a receiving configuration, said fold-up display container comprising:

a main panel designed and arranged into three hinged sections including a front section, a rear section and disposed therebetween a base section hinged along a first edge to said front section and hinged along a second edge to said rear section;

a pair of oppositely disposed side panels hinged to opposite sides of said main panel and designed to attach with said main panel;

said rear section including a main body portion with opposite side edges and a reduced width portion with opposite side edges and a lower edge, said rear section being joined to said base section along said lower edge; and a pair of oppositely disposed support legs, each leg of said pair being integrally connected to a corresponding different one of the side edges of said reduced width portion by a corresponding flexible hinge.

2. A fold-up display container for printed material and discrete articles which is initially in flat form and folded into a receiving configuration, said fold-up display container comprising:

a base panel having a front edge, rear edge and oppositely disposed side edges;

a front panel having opposite side edges and a lower edge and being integrally connected along said lower edge to the front edge of said base panel by a flexible hinge arranged into three portions, said three portions being separated by a pair of spaced-apart elevator feet, said elevator feed extending into recesses in said base panel when in said flat form and pivoted out of said recesses when said display container is in said receiving configuration so as to extend beyond said lower edge;

a rear panel having opposite side edges and a lower edge and being integrally connected along said lower edge to the rear edge of said base panel by a flexible hinge;

a first side panel having opposite side edges and a lower edge and being integrally connected along said lower edge to one of the side edges of said base panel by a flexible hinge;

a second side panel having opposite side edges and a lower edge and being integrally connected along said lower edge to the other of the side edges of said base panel by a flexible hinge; and a plurality of two-part locking assemblies for securing together pairs of adjacent panels into a folded-up orientation so as to create a box-like form with a base and four sides and an open top into which material may be placed for display and selection, one part of each two-part locking assembly being disposed as part of one part of each pair of panels and a second part of each corresponding two-part locking assembly being disposed as part of the other panel of each corresponding pair of panels.

3. A container for storage of printed material and discrete articles comprising:

a base panel;

a front panel hinged to said base panel;

a first side panel hinged to said base panel;

a second side panel hinged to said base panel;

a rear panel including a main panel portion with opposite side edges and a reduced width portion with opposite side edges and a lower edge, said rear panel being hinged to said base panel along said lower edge, said rear panel including a pair of oppositely disposed support legs, each leg of said pair being integrally connected to a corresponding different one of the side edges of said reduced width portion by corresponding flexible hinges; and a plurality of two-part connecting means for joining together said front panel with each of said first and second side panels and for joining together said rear panel with each of said first and second side panels, each of said plurality of two-part connecting means including one part defined by one of the two panels to be joined and the other part being defined by the other of said two panels to be joined.

4. A fold-up display container for printed material and discrete articles which is initially in flat form and folded into a receiving configuration, said fold-up display container comprising:

a base panel having a front edge, rear edge and oppositely disposed side edges;

a front panel having opposite side edges and a lower edge and being integrally connected along said lower edge to the front edge of said base panel by a flexible hinge arranged into three portions, said three portions being separated by a pair of spaced-apart elevator feet, said elevator feet extending into recesses in said base panel when in said flat form and pivoted out of said recesses when said display container is in said receiving configuration so as to extend beyond said lower edge;

a rear panel having opposite side edges and a lower edge and being integrally connected along said lower edge to the rear edge of said base panel by a flexible hinge;

a first side panel having opposite side edges and a lower edge and being integrally connected along said lower edge to one of the side edges of said base panel by a flexible hinge;

a second side panel having opposite side edges and a lower edge and being integrally connected along said lower edge to the other of the side edges of said base panel by a flexible hinge; and a like plurality of interlocking attachment means for securing together in a folded-up orientation said front panel, rear panel, first side panel and second side panel into a box-like form with a base and four sides and an open top into which material may be placed for display and selection.

5. A container for storage of printed material and discrete articles comprising:

a base panel;

a front panel hinged to said base panel;

a first side panel hinged to said base panel;

a second side panel hinged to said base panel;

a rear panel including a main panel portion with opposite side edges and a reduced width portion with opposite side edges and a lower edge, said rear panel being hinged to said base panel along said lower edge, said rear panel including a pair of oppositely disposed support legs, each leg of said pair being integrally connected to a corresponding different one of the side edges of said reduced width portion by corresponding flexible hinges; and a plurality of two-part, snap-fit connecting means for joining together said front panel with each of said first and second side panels and for joining together said rear panel with each of said first and second side panels, each of said plurality of two-part, snap-fit connecting means including one part defined by one of two panels to be joined and the other part being defined by the other of the two panels to be joined.

* * * * *

UNITED STATES PATENT AND TRADEMARK OFFICE

CERTIFICATE OF CORRECTION

PATENT NO. : 5,305,875
DATED : April 26, 1994
INVENTOR(S) : Stephen T. Meyer

It is certified that error appears in the above-indentified patent and that said Letters Patent is hereby corrected as shown below:

Column 8, line 66 delete "feed" and substitute therefore --feet--.

Signed and Sealed this

Thirtieth Day of August, 1994

*Attest:*

*Attesting Officer*

Bruce Lehman

BRUCE LEHMAN

*Commissioner of Patents and Trademarks*